US010406048B1

(12) United States Patent
Alghamdi

(10) Patent No.: US 10,406,048 B1
(45) Date of Patent: Sep. 10, 2019

(54) DENTAL CHAIR ATTACHMENT FOR SUPPORTING WHEELCHAIRS

(71) Applicant: KING SAUD UNIVERSITY, Riyadh (SA)

(72) Inventor: Atif Ahmed Saleh Alghamdi, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/357,134

(22) Filed: Mar. 18, 2019

(51) Int. Cl.
*A61G 5/10* (2006.01)

(52) U.S. Cl.
CPC ..... *A61G 5/104* (2013.01); *Y10S 414/134* (2013.01)

(58) Field of Classification Search
CPC .. Y10S 280/02; Y10S 414/134; Y10S 297/04; B62B 1/142; B62B 1/14; B62B 1/26; B66F 9/18; A61G 5/104; A61G 15/10
USPC ..... 16/110.1; 280/250.1, 304.1, 755; 414/450, 451, 462, 490, 678, 921; 297/DIG. 4
See application file for complete search history.

(56) References Cited

U.S. PATENT DOCUMENTS 3,515,294 A * 6/1970 Fougere ..... A61G 3/06 296/63
4,093,303 A * 6/1978 Nelson ..... A61G 3/0808 224/42.4
4,192,549 A * 3/1980 Petersen ..... A61G 5/104 248/143
4,527,944 A 7/1985 Qually et al.
4,561,823 A * 12/1985 Norton ..... A61G 5/104 269/68
4,726,730 A * 2/1988 McConnell ..... A61G 5/104 254/122
4,790,716 A * 12/1988 McConnell ..... A61G 5/104 254/9 C
4,830,567 A 5/1989 Rachman
4,941,799 A * 7/1990 Gordon ..... A61G 5/104 254/124
5,040,939 A 8/1991 Booth
5,144,701 A * 9/1992 Clark ..... A45D 19/04 4/515
5,388,937 A * 2/1995 Farsai ..... B60P 3/077 188/32
5,421,693 A 6/1995 Peterson
(Continued)

FOREIGN PATENT DOCUMENTS

BR MU 9102388-2 U2 9/2013
JP 11-226064 A 8/1999

OTHER PUBLICATIONS

Liu, "Wheelchair Lifts Make Dentistry More Assessable to Seniors," Dentistry Business website, Feb. 18, 2013.

*Primary Examiner* — Gregory W Adams
(74) *Attorney, Agent, or Firm* — Richard C. Litman

(57) ABSTRACT

The dental chair attachment for supporting wheelchairs attaches to the back of a dental chair and reclines a wheelchair when the dental chair is reclined. The wheels of the wheelchair are rolled onto wheel ramps on opposing sides of a back support. Two upper clamps attach the dental chair attachment to the top of the dental chair, and two lower clamps attach the wheelchair to the dental chair attachment. When reclining the dental chair, wheels on the bottom of the back support allow the dental chair attachment to recline simultaneously with the chair by rolling in a direction opposite the dental chair.

11 Claims, 4 Drawing Sheets

(56) References Cited

U.S. PATENT DOCUMENTS

| | | | | | |
|---|---|---|---|---|---|
| 5,472,307 | A * | 12/1995 | Kadlec | A61G 5/104 | 297/344.13 |
| 5,816,763 | A * | 10/1998 | Hamann | B60R 9/06 | 414/462 |
| 5,890,869 | A | 4/1999 | LeMaster et al. | | |
| 6,015,256 | A | 1/2000 | Mesa et al. | | |
| 6,135,480 | A | 10/2000 | James | | |
| 6,478,529 | B1 | 11/2002 | Willey et al. | | |
| 7,954,602 | B2 * | 6/2011 | Stanislao | B66B 9/083 | 187/200 |
| 8,007,220 | B2 * | 8/2011 | Vandyke | A61G 5/104 | 414/678 |
| 9,445,962 | B2 * | 9/2016 | Fletcher | A61G 5/104 | |
| 2008/0143075 | A1 * | 6/2008 | Schramm | A61G 5/104 | 280/304.1 |
| 2012/0037780 | A1 * | 2/2012 | Colon O'Neill | A61G 5/104 | 248/371 |

* cited by examiner

DENTAL CHAIR ATTACHMENT FOR SUPPORTING WHEELCHAIRS

BACKGROUND

1. Field

The disclosure of the present patent application relates to the dental care for handicapped individuals, and particularly to a dental chair attachment for supporting wheelchairs.

2. Description of the Related Art

The number of people occupying wheelchairs, whether on a temporary or permanent basis, numbers in the hundreds of thousands. Even though they are not ambulatory, these persons still need services that the remainder of the public take for granted, such as dental work, hair care, etc.

It has been common practice in the past for a wheelchair occupant to be bodily lifted from the wheelchair and placed in a hydraulically operated dental, hairdresser's, or other reclining chair. Due to the awkwardness of such a move, the fact that the wheelchair occupant is often incapable of assisting, and the fact that many people in wheelchairs are further restrained by colostomy bags, urine bags or other attachments to their body and/or wheelchair, it generally takes two or three people to move an occupant in this way.

In a nursing home, personnel doing such moving are typically required to be certified and licensed for rendering such care. Consequently, the provision of sufficient personnel to move wheelchair-bound patients to the dental chair is both difficult and expensive. In other environments, such as beauty or barber shops and dentists' offices, no trained personnel at all are available for such situations. As an additional complication, many persons in wheelchairs are simply not in good enough physical condition to permit frequent moves of this type.

As a consequence, the need exists within the industry for a simple, inexpensive, lifting apparatus that permits an occupied wheelchair to be pivoted to a desired tilted position during such procedures such as hair-dressing and dental work, or when the need exists for simply placing the occupant in a more relaxed, reclining position.

Thus, a dental chair attachment for supporting wheelchairs solving the aforementioned problems is desired.

SUMMARY

The dental chair attachment for supporting wheelchairs attaches to the back of a dental chair and reclines a wheelchair when the dental chair is reclined. The wheels of the wheelchair are rolled onto wheel ramps on opposing sides of the dental chair attachment. Two upper clamps attach the dental chair attachment to the top of the dental chair, and two lower clamps attach the wheelchair to the dental chair attachment. When reclining the dental chair, wheels on the bottom of the back support allow the dental chair attachment to recline simultaneously with the chair by rolling in a direction opposite the dental chair.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The dental chair attachment for supporting wheelchairs attaches to the back of a dental chair and reclines a wheelchair when the dental chair is reclined. The wheels of the wheelchair are rolled onto wheel supports on opposing sides of the dental chair attachment. Two upper clamps attach the dental chair attachment to the top of the dental chair, and two lower clamps attach the wheelchair to the dental chair attachment. When reclining the dental chair, wheels on the bottom of the back support allow the dental chair attachment to recline simultaneously with the chair by rolling in a direction opposite the dental chair.

Figure 1:
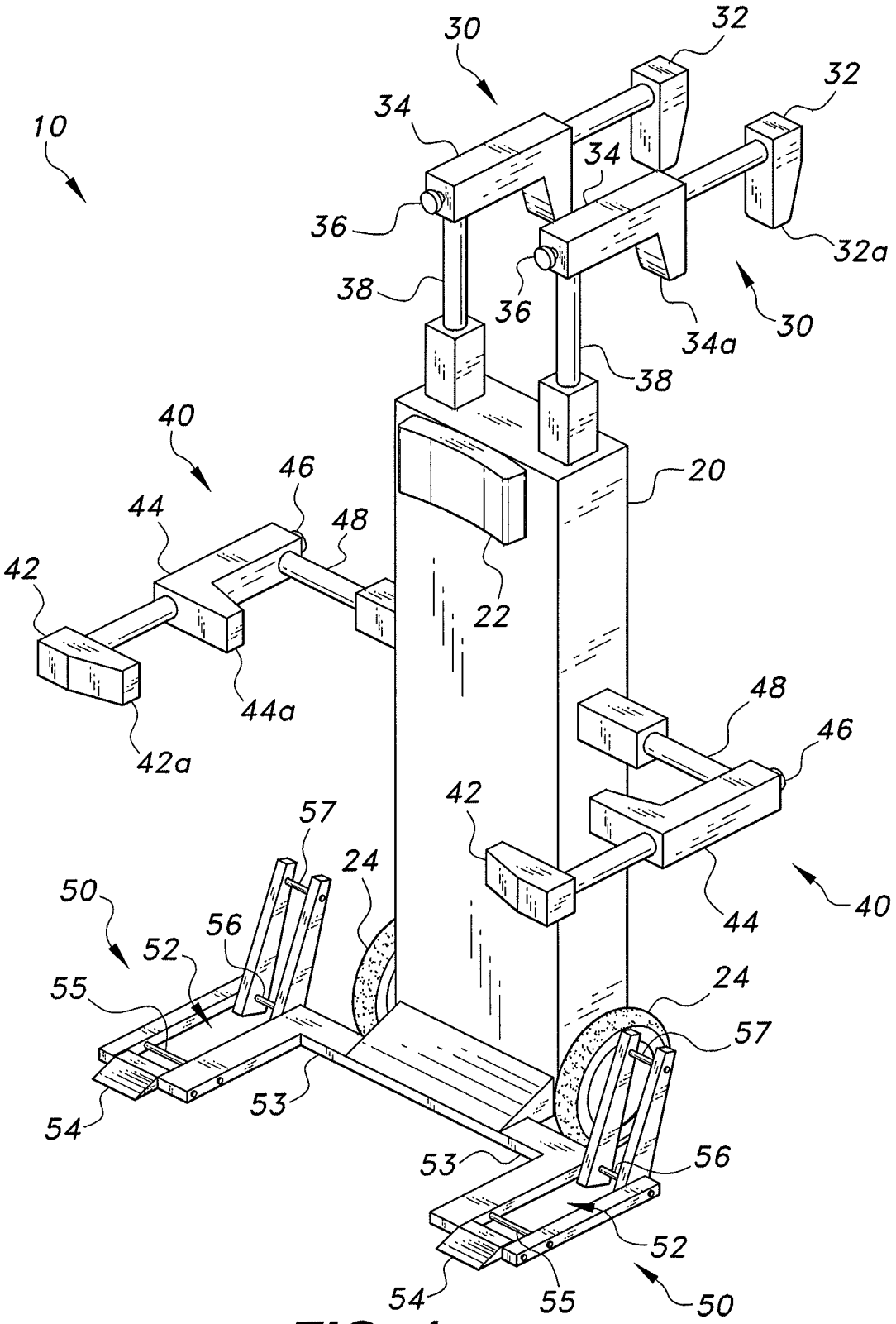
FIG. 1 is a perspective view of a dental chair attachment for supporting wheelchairs.

FIG. 1 shows the dental chair attachment 10 standing upright without a dental chair or wheelchair attached thereto. The dental chair attachment 10 includes a central back support 20 that is designed to be aligned with the patient in the wheelchair. Two upper clamps 30 extend out from a top of the back support 20 in a rearward direction. The upper clamps 30 each have an upper jaw 32 and a lower jaw 34. The upper jaws 32 are selectively adjustable relative to the lower jaws 34 so that the upper clamps 30 can be clamped to the back of a dental chair on opposite sides of the head rest. When the upper jaw 32 and lower jaws 34 are approximated, the ends 32*a*, 34*a* of the jaws 32, 34 clamp the attachment 10 to the top of the dental chair. Knobs 36 on each upper clamp 30 are provided to adjust the position of the jaws 32, 34, and lock the extension member 32 in place when the clamp 30 is tightened. Each upper clamp 30 may be located on top of a selectively lockable telescoping member 38 that extends up from the back support 20. The telescoping members 38 allow the height of the upper clamps 38 to be adjusted for dental chairs having backs with different heights. The jaws 32, 34 may have pads attached to their clamping surface to prevent or reduce damage to the dental chair through their clamping action. The clamping surfaces may also have a high friction to help prevent the upper clamps 30 from sliding off the dental chair.

Two lower clamps 40 are connected to the sides of the back support 20 and extend in a forward direction. The lower clamps 40 are designed for securing the frame of a wheelchair to wheelchair attachment device 10. The lower clamps 40 may be configured similarly to the upper clamps 30 by having a lower jaw 44 and an upper jaw 42 that are movable relative to each other. Knobs 46 allow an operator to adjust the upper jaw 42 relative to the lower jaw 44 and secure the clamp 40 in place when the wheelchair is adequately secured. Each lower clamp 40 may be attached to the back support 20 by telescoping members 48 that extend out from the sides of the back support 20. The telescoping members 48 allow the distance between the lower clamps 40 to be adjusted for accommodating wheelchairs of different widths. The clamping surface of the jaw ends 42*a*, 44*a* may have a coating of a material, such as rubber, that can conform to the wheelchair and increase friction between the clamping surface and the wheelchair frame.

Two wheel ramps 50 extend out from the front of the back support 20 in a forward direction. The wheel ramps 50 include central wheel channels 52 designed to accept and cradle the wheels of a wheelchair. Accordingly, the wheel ramps 50 are attached to horizontal members 53 that set the wheel ramps 50 at a width equal to the distance between wheelchair wheels. In some embodiments, the horizontal members 53 may include telescoping mechanisms to accommodate wheelchairs of varying widths. Each wheel channel 52 includes a front bar 55 and a back bar 52 extending across its width to lift the wheelchair wheels when the dental chair attachment 10 is reclined. An inclined plane 54 is positioned at the front of the wheel channels 52 to guide the wheelchair wheels over the front bar 55 when loading the wheelchair into the wheel channels 52. A rear stop 57 is secured to the back of the wheel channels 52. The rear stop 57 includes two upright members extending up from a lower portion of the wheel ramp 50 and an upper rod extending between the two members at their upper end. The upper rod prevents the wheelchair wheels from rolling backwards when the dental chair attachment 10 is reclined.

The back support 20 includes a headrest 22 attached to its front surface at the upper end. The headrest 22 is designed to support a patient's head at the proper position when the dental chair attachment 10 is reclined. Accordingly, the headrest 22 may be made of a soft material or upholstered to promote patient comfort and may also have an arcuate front surface to partially wrap around the patient's head for stability. A thickness of the headrest 22 may be selected based on a head position desired by the practitioner. A thinner headrest 22 will tilt the patient's head back further, while a thick headrest 22 will position the patient's head at more upright angle. In some embodiments, the headrest 22 may have an adjustable height. The height adjustability me be accomplished by attaching the headrest 22 and back support 20 using a peg and hole connection with holes at varying heights. Wheels 24 are attached to the bottom of the back support 20. The wheels 24 are aligned to allow the lower end of the back support 22 to roll forward or backwards when the attached dental chair back is reclined or inclined.

Figure 2:
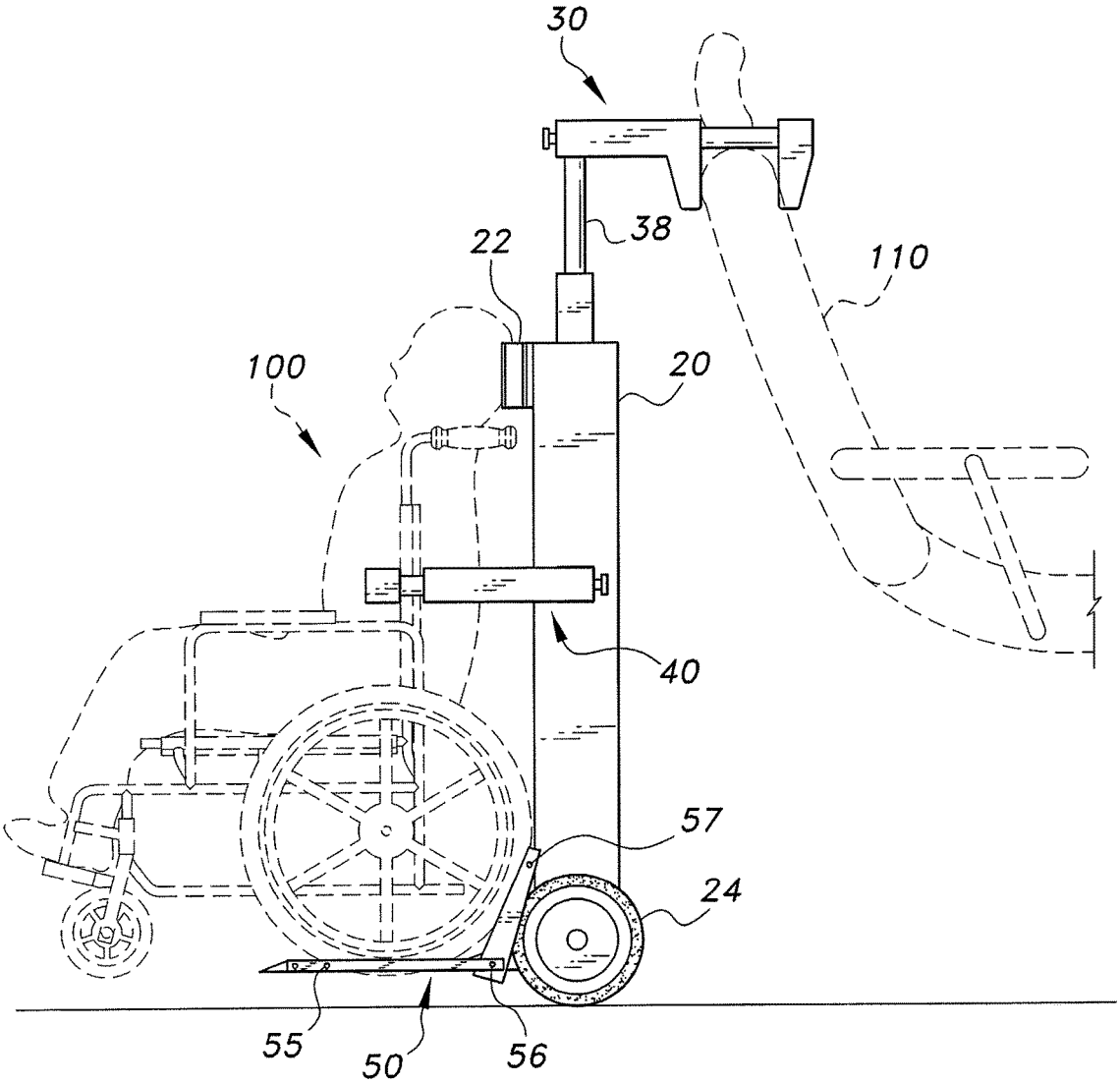
FIG. 2 is a side view of the dental chair attachment for supporting wheelchairs of FIG. 1, shown with a wheelchair (in broken lines) in an upright position and with a dental chair (also in broken lines).

FIG. 2 shows the dental chair attachment 10 connected to a dental chair 110 in an upright position. A patient 100 in a wheelchair is supported by the dental chair attachment 10 and is oriented in an upright position. The wheelchair wheels are held in place by the rods 55, 56, 57 of the wheel ramps 50, which prevents the wheelchair wheels from rolling forward or backwards. The lower clamps 40 are clamped to the frame or backrest of the wheelchair, thus preventing the chair from tipping forward or backwards, and securing the wheelchair to the dental chair attachment 10. The dental chair attachment 10 is secured to the top of the dental chair 110 by the upper clamps 30, which are clamped to the top of the chair 110.

Figure 3:
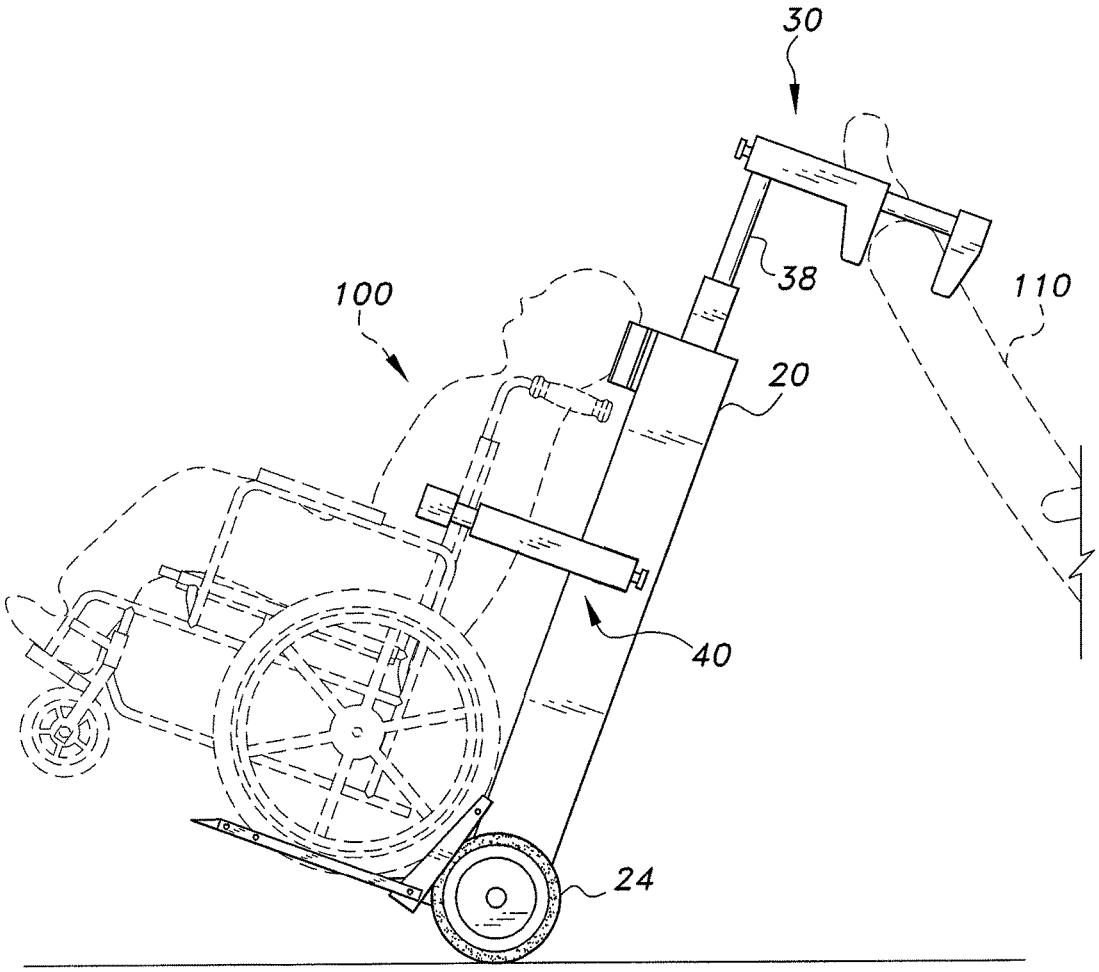
FIG. 3 is a side view of the dental chair attachment for supporting wheelchairs of FIG. 1, shown with a wheelchair (in broken lines) tilted towards a reclined position.

When the back of the dental chair 110 is reclined, the distance between the top of the chair 110 and the ground is decreased. To compensate for this decrease in height, the wheels 24 of the dental chair attachment 10 roll away from the dental chair 110 as the top of the dental chair 110 back lowers. As seen in FIG. 3, the wheels 24 rolling away from the dental chair 110 cause the patient 100 and dental chair attachment 10 to recline. In some embodiments, the upper clamps 30 may be connected to the telescopic members 38 via a hinge that pivots in the vertical plane. The hinge will allow the upper clamps 38 to remain aligned with the top of the dental chair 110 when the dental chair attachment 10 pivots in the opposite direction. The hinge may also be spring-loaded to provide a force against the pivoting motion for added securement to the dental chair 110.

The dental chair attachment device for supporting wheelchairs may be used with other power reclining chairs. For example, it may be used in medical or nursing home settings.

Figure 4:
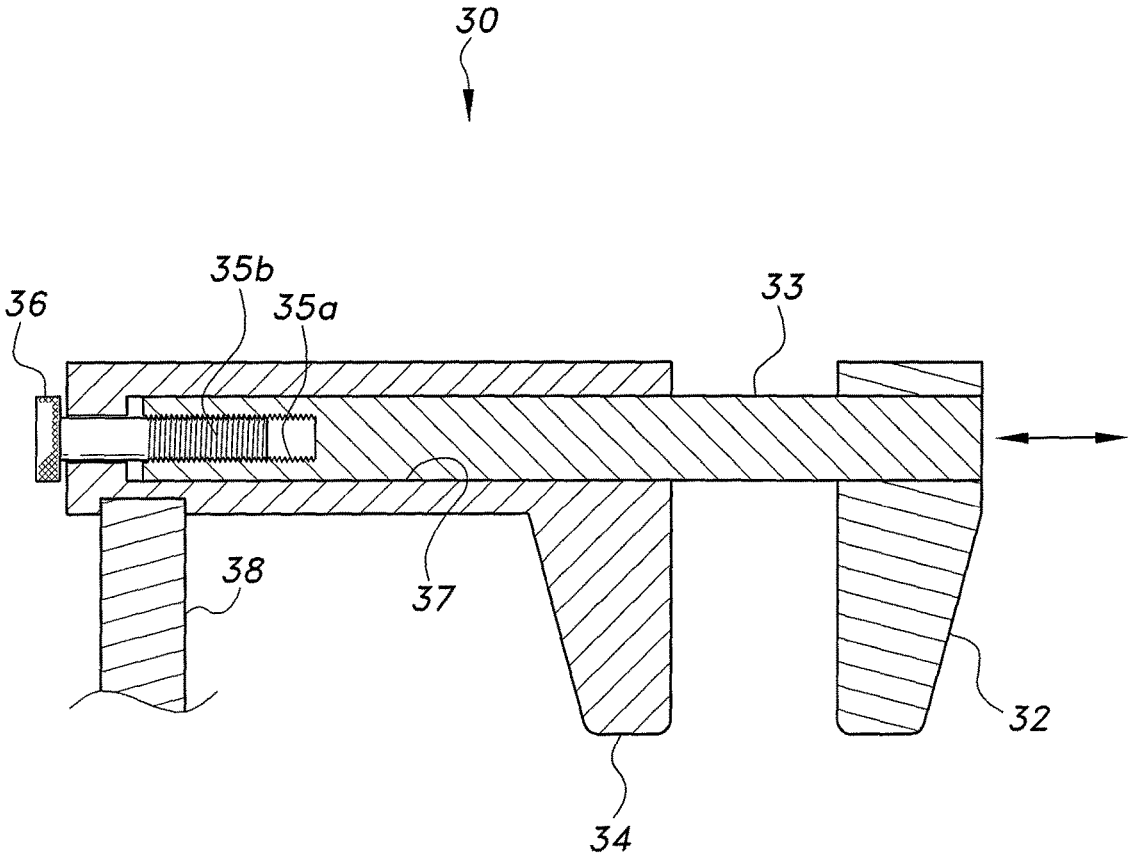
FIG. 4 is a side view in section of a clamp attaching the dental chair attachment for supporting wheelchairs of FIG. 1 to the dental chair.

The upper clamps 30 and lower clamps 40 may be any clamping mechanism known in the art. One embodiment of the upper clamps 30 is shown in FIG. 4, the lower clamps 40 being similar. The upper jaw 32 includes a shaft movable within a bore 67 in the lower jaw 34. Rotating the knob 36 moves the upper jaw 32 relative to the lower jaw 34 through a screw drive 35*a,b* between the knob 36 and the shaft 33. A bearing surface may be applied to the inside of the bore 37 or the outside of the shaft 33 to reduce friction and prevent wear on the contacting surfaces. To operate the clamp 30, an operator will turn the knob 36 in one direction to increase the distance between the clamp jaws 32, 34, place either the dental chair or wheel chair in between the clamp jaws 32, 34, and then turn the knob 36 in the opposite direction to approximate the clamp jaws 32, 34. Once in a desired position, the knob 36 will be released and the threaded connection 35*a,b* will lock the clamp jaws 62,63 in place.

It is to be understood that the present subject matter is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A dental chair attachment for supporting wheelchairs, comprising:

an elongate back support having a top, a bottom, and opposing right and left sides;

a left upper clamp attached to the top of the back support, the left upper clamp extending in a rearward direction;

a right upper clamp attached to the top of the back support, the right upper clamp extending in the rearward direction;

a left lower clamp attached to the left side of the back support, the left lower clamp extending forward;

a right lower clamp attached to the right side of the back support, the right lower clamp extending forward;

a left wheel ramp attached to the bottom of the back support, the left wheel ramp extending forward;

a right wheel ramp attached to the bottom of the back support, the right wheel ramp extending forward; and a left wheel and a right wheel attached to the bottom of the back support, the attachment being supported on the wheels when tilted rearward with the upper clamps attached to a dental chair.

2. The dental chair attachment for supporting wheelchairs according to claim 1, wherein:

the elongate back support has a front surface, a left side surface, a right side surface, and a top surface;

the left upper clamp is attached to a left side of the top surface of the back support;

the right upper clamp is attached to a right side of the top surface of the back support;

the left lower clamp is attached to the left side surface of the back support;

the right lower clamp is attached to the right side surface of the back support.

3. The dental chair attachment for supporting wheelchairs according to claim 1, wherein each of the upper clamps includes a lower jaw having a bore defined therein, an upper jaw having a shaft extending therefrom, the shaft being movable in the bore in the lower jaw to open and close the clamp, and an adjustment knob mounted on the lower jaw coaxial with the bore, wherein rotating the knob causes the upper jaw to move relative to the lower jaw.

4. The dental chair attachment for supporting wheelchairs according to claim 1, wherein each of the lower clamps includes a lower jaw having a bore defined therein, an upper jaw having a shaft extending therefrom, the shaft being movable in the bore in the lower jaw to open and close the clamp, and an adjustment knob mounted on the lower jaw coaxial with the bore, wherein rotating the knob causes the upper jaw to move relative to the lower jaw.

5. The dental chair attachment for supporting wheelchairs according to claim 1, further comprising a padded headrest attached to a front of the back support proximate the upper clamps.

6. The dental chair attachment for supporting wheelchairs according to claim 1, wherein each of the wheel ramps includes a channel extending at least partially along its length in a front to rear direction.

7. The dental chair attachment for supporting wheelchairs according to claim 6, wherein each of the wheel ramps includes a front rod extending across the channel.

8. The dental chair attachment for supporting wheelchairs according to claim 7, wherein an inclined plane is located at a front of each channel.

9. The dental chair attachment for supporting wheelchairs according to claim 6, wherein each wheel ramp includes a back stop extending up from its rear.

10. The dental chair attachment for supporting wheelchairs according to claim 1, wherein the upper clamps are adjustable in height.

11. The dental chair attachment for supporting wheelchairs according to claim 1, wherein the lower clamps are adjustable in length laterally.

* * * * *